United States Patent [19]

Rhoads

[11] B 3,999,614

[45] Dec. 28, 1976

[54] RIPPER TIP WITH INTER-FITTING SHIN GUARD RETAINING MEANS

[75] Inventor: Kenneth A. Rhoads, East Peoria, Ill.

[73] Assignee: Caterpillar Tractor Co., Peoria, Ill.

[22] Filed: Dec. 11, 1970

[21] Appl. No.: 97,259

[44] Published under the second Trial Voluntary Protest Program on March 9, 1976 as document No. B 97,259.

[52] U.S. Cl. ..... 172/719; 37/142 R; 172/753

[51] Int. Cl.[2] ..... A01B 15/02; A01B 23/02

[58] Field of Search ..... 172/699, 700, 719, 753, 172/769, 772; 37/142

[56] References Cited

UNITED STATES PATENTS

| | | | |
|---|---|---|---|
| 7,223 | 3/1850 | Reynolds | 172/753 |
| 1,937,243 | 11/1933 | Pearch | 172/753 |
| 2,310,336 | 2/1943 | Zwaska | 172/753 |
| 3,254,727 | 6/1966 | Helton et al. | 172/719 |
| 3,536,147 | 10/1970 | Norton | 172/719 |

FOREIGN PATENTS OR APPLICATIONS

| | | | |
|---|---|---|---|
| 479,640 | 12/1951 | Canada | 172/753 |
| 246 | 1882 | United Kingdom | 172/719 |
| 920,825 | 3/1963 | United Kingdom | 37/142 R |

*Primary Examiner*—Clyde I. Coughenour
*Attorney, Agent, or Firm*—Phillips, Moore, Weissenberger, Lempio & Strabala

[57] ABSTRACT

An earth ripping apparatus is provided with a replaceable ripper tip which is releasably attached to the lower end of a shank latching means which functions in cooperative association with a wear plate carried along the leading edge of the shank.

1 Claim, 7 Drawing Figures

INVENTOR
KENNETH A. RHOADS

BY
Fryer, Tjensvold, Feix, Phillips & Lempio
ATTORNEYS

INVENTOR
KENNETH A. RHOADS

BY
Fryer, Tjensvold, Feix, Phillips & Lempio
ATTORNEYS

RIPPER TIP WITH INTER-FITTING SHIN GUARD RETAINING MEANS

BACKGROUND OF THE INVENTION

This invention relates to earth ripping apparatus and pertains more particularly to ripping apparatus which includes a replaceable tip and shank guard.

Earth ripping machines normally employ replaceable shoes or tips on an elongated shank which extends into the earth formation. The tip and portions of the shank which contact the earth are subjected to vigorous abrasion during the ripping operation. For this reason replaceable hardened tips and wear plates are provided so that the entire shank does not have to be replaced often. The prior art devices employ pins and slots to retain the tips and wear plates in place. These slots and holes for pins are areas of high stress concentration and thus contribute to early failure of the shank. Therefore it is the primary object of the present invention to provide attaching means for ripper points which eliminate holes and notches in high stress areas of the shank.

A further object of the present invention is to provide a ripper point which is quickly latched to the end of a shank by cooperative engagement with a wear plate.

BRIEF DESCRIPTION OF THE DRAWINGS

The above and other objects and advantages of the present invention will become apparent from the following description when read in conjunction with the accompanying drawings in which.

DETAILED DESCRIPTION OF PREFERRED EMBODIMENTS

Figure 1:
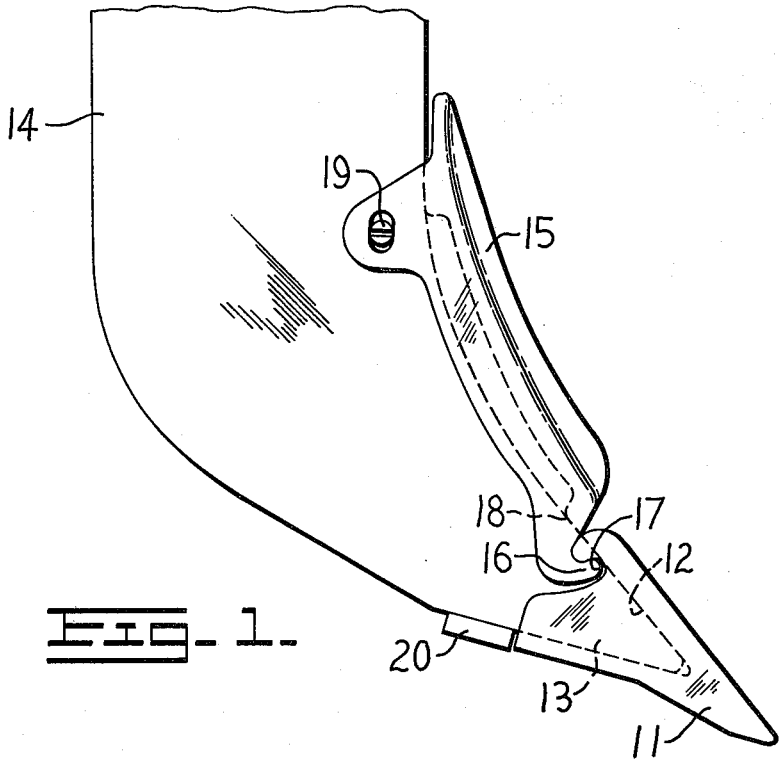
FIG. 1 is a side elevational view of a ripper shank and point constructed in accordance with the present invention.

Referring now to the drawings, and more particularly to FIG. 1, there is illustrated an embodiment of the present invention which comprises a ripper tip or shoe member 11, having a socket 12 formed therein and adapted to receive the generally tapered or wedge-shaped lower end 13 of a ripper shank 14. Latchable retaining means for the ripper tip comprises a shank shin guard or wear plate 15 having a hook member or portion 16 carried on each side of the shin guard which extends into a recess 17 formed in each side wall of the tip 11. The shin guard 15 pivots counterclockwise about a pivot point 18, which engages the shank 14, for latching engagement with the tip 11 and is retained in latching position by means of a pin or screw 19. Stop means such as a block 20 may be formed or attached to the lower edge of the tip for engagement with the lower trailing edge of the tip 11 to provide a greater distribution of forces.

Figure 2:
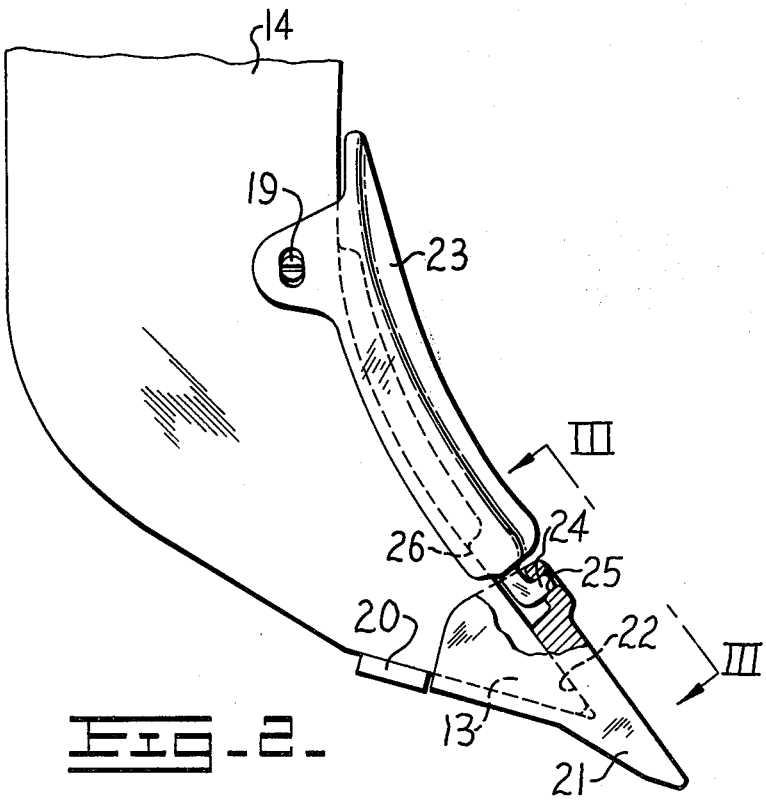
FIG. 2 is a side elevational view, partially in section, of a second embodiment of the present invention.
Figure 3:
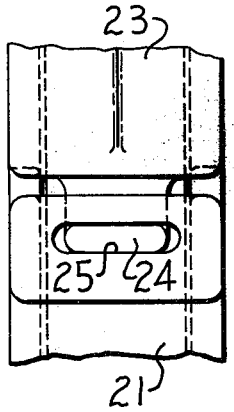
FIG. 3 is a view generally along lines III—III of FIG. 2.

Referring now to FIGS. 2 and 3, there is illustrated a ripper tip 21 provided with a socket 22 for receiving the lower end 13 of the shank 14. A shank shin guard 23 provides latching means comprising a hook 24 adapted to engage a recess or slot 25 formed in a raised portion of the upper surface of the tip 21. As in the previous embodiment, the shin guard 23 is adapted to pivot around a shoulder or abutting surface 26 with the hook 24 extending into engagement with recess 25 and held into latching position by means of a pin or screw 19.

Figure 4:
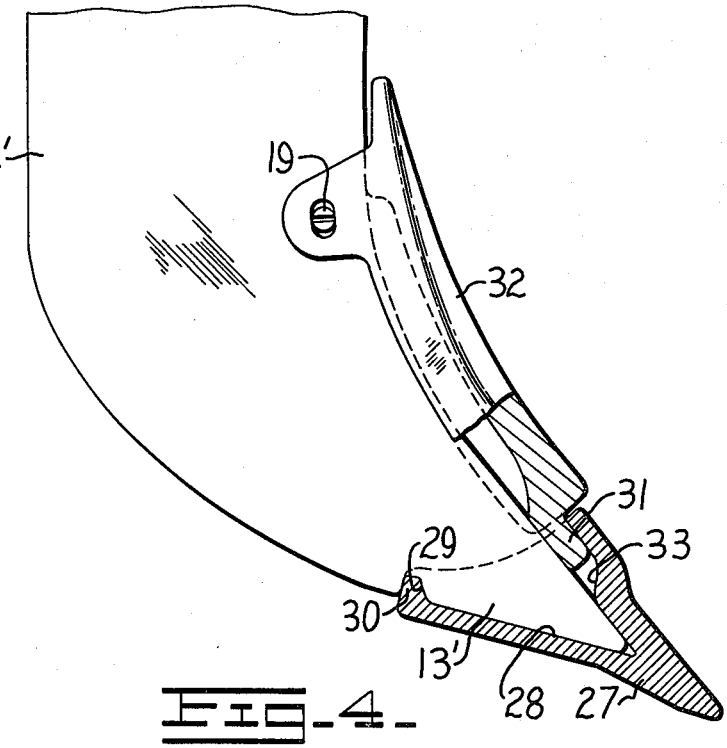
FIG. 4 is a side elevational view, partially in section, of another embodiment of the present invention.

A slightly modified form of the invention is illustrated in FIG. 4 in which a ripper tip 27 is provided with a socket 28 in which is received a wedge-shaped lower end 13' of a shank 14'. A recess or notch 29 formed in the lower edge of the shank 14' is adapted to receive an upward turned hook or flange 30 formed at the rearward edge of the tip 27. The tip 27 is latched into position by means of an extension 31 carried by shin guard 32 and extending into a recess 33 in the tip 27. The shin shank guard 32 is held in position by means of a pin or screw 19.

Figure 6:
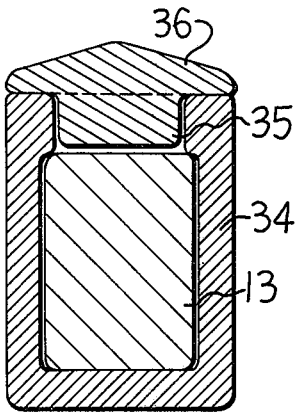
FIG. 6 is a view taken along lines VI—VI of FIG. 5.
Figure 5:
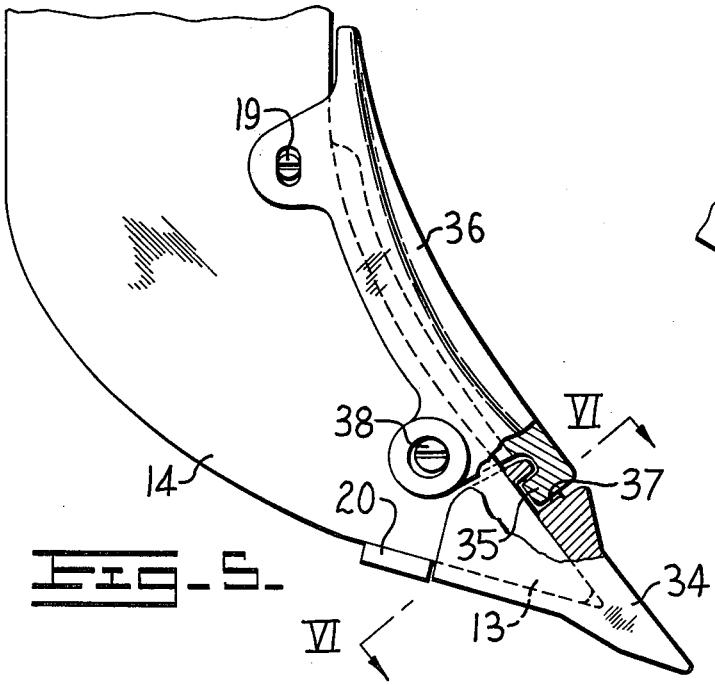
FIG. 5 is a side elevational view, partially in section, of a further embodiment of the present invention.

The embodiment illustrated in FIGS. 5 and 6 comprises a ripper tip 34 fitting on the lower end 13 of a shank 14. The tip 34 is latched into position by means of a hook 35 carried on the lower end of a shank shin guard 36 and engaging a slot or recess 37 formed in the upper surface of the tip 34. The shin guard 36 is held into place by a pair of spaced apart pins or screws 19 and 38.

Figure 7:
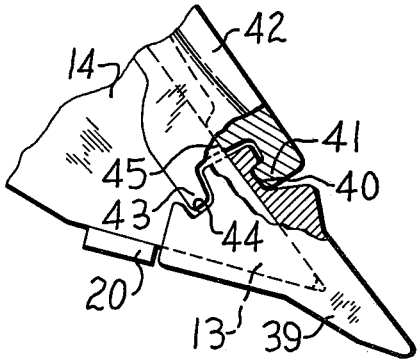
FIG. 7 is a side elevational view, partially in section, of a still further embodiment of the present invention.

The FIG. 7 embodiment illustrates means by which the lower retaining pin or screw 38 of FIG. 5 can be eliminated. In this arrangement, a ripper tip 39 is provided with a notch 40 which is engaged by a hook 41 carried on a shin guard 42. A pair of tangs 43, on each side of the shin guard 42, extend into slots 44 formed in the side walls of the tip 39. The shin guard 42 is pivoted about a shoulder 45 in engagement with a leading edge of the shank 14 and is retained in position by a retaining pin or screw 19 as in the previous embodiment.

What is claimed is:

1. An earth ripper apparatus having a replaceable tip, said apparatus comprising:

an elongated shank member having an upper portion, and a lower end portion adapted to extend below the surface of the earth;

said shank having a forwardly directed generally tapered foot portion at said lower end portion;

a removable shoe having a socket which receives said foot portion, and a hook receiving recess formed in the side wall of said shoe an elongated removable wear plate having a lower end including hook means, said plate extending along and carried by the leading edge of said shank and having an upper end terminating above said tapered foot portion of said shank said hook means engaging said hook receiving recess to retain said shoe on said foot and to retain said lower end of said wear plate in place against the leading edge of said shank at said foot portion; and, single pin means engaging said wear plate proximate said upper end and said shank above said tapered foot portion to retain said wear plate and said shoe in place in said shank so that said removable shoe is held in place on said shank solely by engagement of said hook means extending from said wear plate into said recess in said removable shoe, and said plate and shoe together secured to said shank solely by said single pin means engaging said shank above said foot portion.

* * * * *